US005849244A

United States Patent [19]

Rhodes et al.

[11] Patent Number: 5,849,244

[45] Date of Patent: Dec. 15, 1998

[54] METHOD FOR VACUUM LOADING

[75] Inventors: Terry C. Rhodes, Pittsburgh; Henry E. Brinzer, Jr., Imperial; Frank J. Rizzo, McMurray, all of Pa.

[73] Assignee: Crucible Materials Corporation, Syracuse, N.Y.

[21] Appl. No.: 627,547

[22] Filed: Apr. 4, 1996

[51] Int. Cl.[6] ..... C21D 1/74

[52] U.S. Cl. ..... 266/250; 419/60

[58] Field of Search ..... 266/249, 250; 419/49, 60

[56] References Cited

U.S. PATENT DOCUMENTS

| | | | |
|---|---|---|---|
| 3,042,594 | 7/1962 | Hauth . | |
| 3,892,030 | 7/1975 | De Pierre et al. . | |
| 4,056,368 | 11/1977 | Rozmus | 266/250 |
| 4,104,061 | 8/1978 | Roberts . | |
| 4,348,212 | 9/1982 | Rozmus | 266/250 |
| 4,388,088 | 6/1983 | Rozmus, Jr. et al. | 266/250 |
| 4,632,702 | 12/1986 | DiGiambattista . | |
| 4,647,426 | 3/1987 | Fiorentino . | |
| 4,762,679 | 8/1988 | Gegel et al. . | |
| 4,836,978 | 6/1989 | Watanabe et al. . | |
| 4,940,404 | 7/1990 | Ammon et al. . | |
| 4,999,157 | 3/1991 | Nishio et al. . | |
| 5,039,476 | 8/1991 | Adachi et al. . | |
| 5,069,868 | 12/1991 | Tokiai et al. . | |
| 5,217,664 | 6/1993 | Feichtinger . | |
| 5,269,830 | 12/1993 | Rabin et al. . | |
| 5,330,704 | 7/1994 | Gilman . | |
| 5,451,244 | 9/1995 | Castledine . | |

OTHER PUBLICATIONS

Flécher et al., "Vacuum Degassing of Metal Powders," Int'l. Journal of Powder Metallaurgy and Powder Tech., vol. 19, No. 4, Dec. 1983, pp. 269–267.

Haeussermann et al. "Dynamic Powder Degassing–Principles and Application, " Leybold–Heraeus GmbH, Germany Dec. 1990.

*Primary Examiner*—Scott Kastler

*Attorney, Agent, or Firm*—Finnegan, Henderson, Farabow, Garrett & Dunner, L.L.P.

[57] ABSTRACT

A method and apparatus for loading tool steel and high speed steel powder to a deformable mold for compacting is disclosed. The particles are exposed to a uniform vacuum during transfer from a sealed container through a sealed conduit and into a sealed deformable mold. By this method and apparatus, the particles are uniform throughout the container and substantially free of impurities, without requiring conventional outgassing.

9 Claims, 1 Drawing Sheet

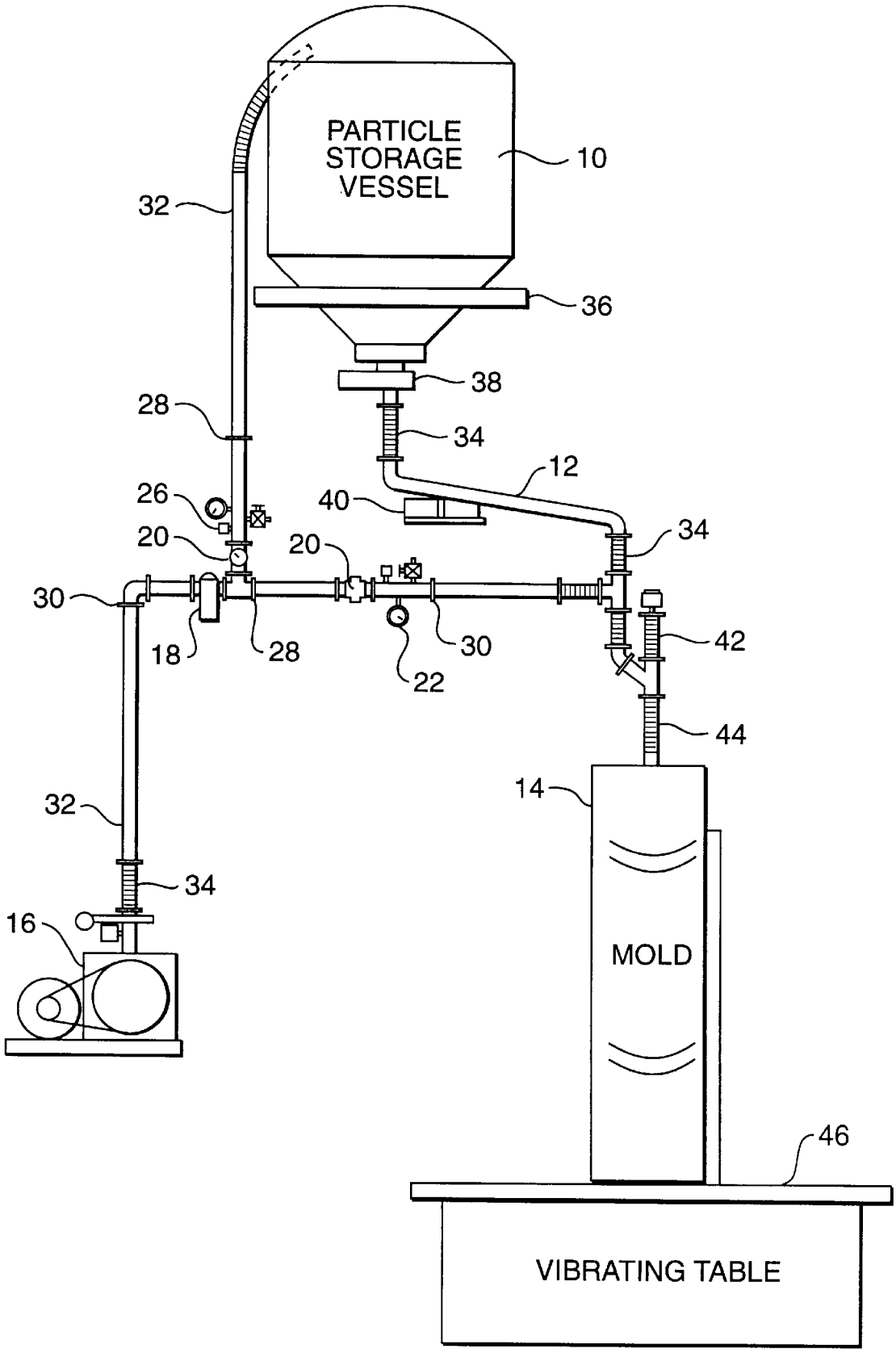
PARTICLE
STORAGE
VESSEL
10
32
36
38
28
34
12
26
40
34
20
20
30
18
28
30
22
42
44
14
32
34
16
MOLD
46
VIBRATING TABLE

METHOD FOR VACUUM LOADING

BACKGROUND OF THE INVENTION

1. Brief Description of the Invention

The present invention relates to a method for loading tool steel and high speed steel powder into a deformable mold for compacting, with the powder during transport to the mold being under dynamic, uniform vacuum.

2. Brief Description of the Prior Art

Incident to the powder-metallurgy production of tool steel and high speed steel articles, prealloyed particles of the composition from which the article is to be made are loaded into a deformable container. This deformable container is then sealed and the prealloyed particles therein are consolidated by hot isostatic pressing within a gas-pressure vessel. To achieve the desired product quality, particularly from the standpoint of uniformity of microstructure and the absence of deleterious impurities, such as oxides, it is important that the powder be free of these impurities at the time of compacting. This is typically achieved by outgassing the deformable mold after the powder has been loaded therein and before sealing for consolidation as by hot isostatic pressing. As a result of the significant size and quantity of powder within the mold, it is difficult to achieve removal of impurities during outgassing uniformly with respect to the powder from top to bottom of the mold. Typically, the powder at the top of the mold, which is near the stem through which outgassing is accomplished, is at a much lower impurity level than the powder at the bottom of the mold. Consequently, after consolidation, the impurity level and thus the properties of the consolidated article may vary along the length thereof.

SUMMARY OF THE INVENTION

It is accordingly an object of the present invention to overcome these difficulties with respect to conventional loading of tool and high speed steel powders for consolidation and to provide a method and apparatus wherein the particles are uniform throughout the container and substantially free of impurities, without requiring conventional outgassing.

This is achieved in accordance with the method of the invention by providing a desired quantity of prealloyed particles of tool or high speed steel within a sealable container. This container acts as a source of prealloyed powder particles for transfer to the deformable mold used for consolidation by hot isostatic pressing. The container is sealed and evacuated to provide a vacuum therein. Likewise, the mold, which is of a compressible material, is sealed and evacuated to likewise provide a vacuum therein. The prealloyed particles are introduced from the container to the evacuated mold through a sealed, evacuated conduit.

The evacuation of the container and the mold may be selectively performed either sequentially or simultaneously using selective valving. The compacting of the prealloyed particles within the deformable container may be performed without outgassing the mold after evacuation thereof and loading of the particles therein.

The selective evacuation of the container and mold may be achieved by the use of a single vacuum pump. The vacuum pump is isolated from the prealloyed particles.

Preferably, a dynamic vacuum is maintained within the container, mold, and conduit during introduction of the prealloyed particles from the container to the mold. This establishes a substantially uniform vacuum level for the prealloyed particles introduced through the sealed, evacuated conduit. Hence, the prealloyed particles throughout the container have been exposed to a uniform level of vacuum during the loading operation and thus exhibit uniform cleanliness along the entire length of the mold.

The apparatus for use in the practice of the invention includes a sealable container having a quantity of prealloyed particles therein. Means such as a vacuum pump may be used for evacuating the container to provide the vacuum therein. A sealable, compressible mold, which likewise may be evacuated by the same pump to provide a vacuum therein is adapted for sealing. A conduit is provided for transferring the prealloyed particles from the container to the mold while exposing the particles to a uniform level of vacuum during this transfer operation. In this manner, the particles are protected from contamination prior to and during compacting and exhibit uniform cleanliness. Means such as a pump may be provided for selectively evacuating the container and the mold either sequentially or simultaneously. In this regard, a single vacuum pump may be employed for evacuating the container, mold, and conduit means.

The vacuum pump is isolated from the prealloyed particles.

Valves are provided within the conduit for permitting evacuation of the container and mold via the conduit by the pump, while isolating the pump from the prealloyed particles within the conduit.

Vibrating of the mold is provided for during transferring of the particles to the mold for purposes of increasing the packing density of the particles within the mold.

Transfer of the particles may be effected by a vibrating feeder integral with the conduit.

A weigh scale may be provided for determining the weight of the particles transferred from the container to the mold. This weigh scale is preferably associated with the prealloyed particle container.

A level indicator may be provided in association with the mold for determining the level of the particles within the mold.

BRIEF DESCRIPTION OF THE DRAWING

The single FIGURE of the drawing is a somewhat schematic assembly of an embodiment of an apparatus for use in the practice of the invention.

DESCRIPTION OF THE PREFERRED EMBODIMENTS

With reference to the FIGURE, there is shown an example of apparatus in accordance with the invention. A prealloyed particle storage vessel designated as 10 is provided as a source of powder particles for transmission through conduit system 12 to the compressible mold 14. A vacuum pump 16 is provided in association with the conduit system 12 and vacuum manifold 32 to evacuate the conduit system as well as the storage container 10 and mold 14.

The vacuum pump 16 is isolated from the powder particles by a cyclone filtration system and element filters 18. Selective valving 20 is employed to permit the vacuum pump to evacuate the container 10 and billet 14 sequentially by evacuating one then the other or, alternatively, simultaneously. Compound gauges 22 and thermistor gauges 26 monitor the pressure of the conduits and pressure dampers 28 are used to regulate the gas flow rate. The conduit system 12 is of stainless steel tubing terminating at each end with O-ring gasket fittings 30 connecting the vacuum manifold 32 portion of the conduit system 12 to the container and mold.

Stainless steel flexible hoses 34 isolate the container and mold from vibration and compressive forces caused by pressure changes to allow dynamic weighing of the prealloyed particles delivered from the container to the mold. A weigh scale 36 is provided in association with the container 10 for this purpose. This weigh scale determines the weight of the particles transferred from the container to the mold.

The flow rate of the particles being transferred through the conduit system 12 is regulated by the operation of valve 38 and amplitude feeder 40. The amplitude feeder 40 may be a conventional vibratory feeder, such as a Syntron vibrator. The level of the powder within the mold 14 is determined by a level detector 42. When the mold is filled to the desired level, the level detector is removed and the stem 44 is heated, crimped, or swaged to achieve a mechanical seal. The cut portion is welded to achieve a reliable seal. Since the particles travelling from the container 10 through the conduit system 12 to the container 14 are subject continuously to evacuation by the action of pump 16 through manifold 32, each particle is exposed to substantially the same vacuum level and thus the particles are uniform from top to bottom of the container 14.

To facilitate packing density of the particles within the container 14, a vibrating table 46 is used in association with the mold 14 to vibrate the same during the loading of powder into the mold.

What is claimed is:

1. Apparatus for the powder metallurgy production of tool steel and high speed steel articles, said apparatus comprising a sealable container having a quantity of prealloyed particles therein, means for evacuating said container to provide a vacuum therein, a sealable, compressible mold, means for evacuating said mold to provide a vacuum therein, means for sealing said mold, and conduit means for transferring said prealloyed particles from said container to said mold while exposing said particles to a uniform level of vacuum during said transferring, with said sealable container, said means for evacuating and said sealable, compressible mold being interconnected, whereby said particles are protected from contamination prior to and during compacting and exhibit uniform cleanliness.

2. The apparatus of claim 1, further including selective valving means for selectively evacuating said container and said mold either sequentially or simultaneously.

3. The apparatus of claim 1, further including a single vacuum pump for evacuating said container, mold, and conduit means.

4. The apparatus of claim 3, further including means for isolating said vacuum pump from said prealloyed particles.

5. The apparatus of claim 4, further including valves provided within said conduit means for permitting evacuation of said container and mold via said conduit means by said pump while isolating said pump from said prealloyed particles within said conduit means.

6. The apparatus of claim 1, further including means for vibrating said mold during said transferring of said particles to said mold to increase the packing density of said particles within said mold.

7. The apparatus of claim 1, further including a vibrating feeder constituting a portion of said conduit means.

8. The apparatus of claim 1, further including a weight scale for determining the weight of said particles transferred from said container to said mold.

9. The apparatus of claim 8, further including a level indicator for determining the level of said particles in said mold.

* * * * *